United States Patent [19]

Oloff et al.

[11] 4,120,266

[45] Oct. 17, 1978

[54] SUBHUMAN PRIMATE RESTRAINT SYSTEM

[75] Inventors: Clarence M. Oloff, Montgomery County; Alva A. Karl, Dayton; Walter M. Wolff, Enon; Lloyd W. Halbrook, Dayton, all of Ohio; Ray D. Brown, Galveston, Tex.; Raymond G. Dickey, Dayton, Ohio

[73] Assignee: The United States of America as represented by the Secretary of the Air Force, Washington, D.C.

[21] Appl. No.: 753,959

[22] Filed: Dec. 23, 1976

[51] Int. Cl.[2] ..... A61D 3/00

[52] U.S. Cl. ..... 119/103

[58] Field of Search ..... 119/103; 128/361, 434

[56] References Cited

U.S. PATENT DOCUMENTS

| | | | |
|---|---|---|---|
| 1,089,283 | 3/1914 | Stebbins | 119/103 |
| 2,982,248 | 5/1961 | Hosko | 119/103 |

*Primary Examiner*—Louis G. Mancene
*Assistant Examiner*—Robert F. Cutting
*Attorney, Agent, or Firm*—Joseph E. Rusz; Richard J. Killoren

[57] ABSTRACT

A subhuman primate restraint apparatus having a body support plate and adjustable seat and leg supports mounted on a frame which in turn is mounted on a pair of attachment plate members. The attachment plate members are for securing the restraint apparatus to a platform which may be secured to a centrifuge.

The arms and legs of the animal are secured by U-shaped restraint members which are secured to standard over center toggle clamps. A lap strap and shoulder blocks prevent removal of the arms and legs from the U-shaped restraint members. Two body straps secure the animal to the body support plate. A slidable neck restraint holds the head and neck in place. An energy absorbing pad is placed over the body support plate.

6 Claims, 10 Drawing Figures

SUBHUMAN PRIMATE RESTRAINT SYSTEM

RIGHTS OF THE GOVERNMENT

The invention described herein may be manufactured and used by or for the Government of the United States for all governmental purposes without the payment of any royalty.

BACKGROUND OF THE INVENTION

This invention relates to a subhuman primate restraint apparatus.

In the past, subhuman primates, both large and small were centrifuged or experienced G-forces only when anesthetized. More recently the animals have been tranquilized, placed in restraints and then permitted to awaken before being exposed to experimental techniques.

Small animals, less than 10 pounds, have been restrained with nylon webbing in conjunction with clamps. With larger animals, it is more difficult to provide restraints. If larger animals are not properly restrained, they may free themselves from the restraints which may cause injury to the animal and also may endanger the personnel making the tests. Therefore, larger animals have been anesthetized and placed in full body casts. These animals were then permitted to awaken before the tests were begun. The use of full body casts severely limits the tests that can be made on these animals.

BRIEF SUMMARY OF THE INVENTION

According to this invention, a restraint apparatus for large animal primates is provided which immobilizes the animal in such a manner as to prevent escape of the animal after the animal awakens from the anesthesia. The device also has means for preventing strangulation or occulsion of major vessels to the brain during the test.

The test apparatus includes an adjustable frame member for accommodating various sizes of animals. The arms and legs of the animal are secured to the frame with U-shaped restraints secured to over center toggle clamps. A lap strap is provided to immobilize the legs to prevent removal of the legs from the leg clamps. Movable upper arm restraints prevent removal of the arms from the arm clamps. A movable neck restraint holds the neck and head of the animal in place. The neck restraint is made slidable on a pair of support rods to prevent strangulation or occlusion of major vessels to the brain during the tests. Two body straps are provided to secure the animal to the frame.

IN THE DRAWING

DETAILED DESCRIPTION OF THE INVENTION

Figure 1:
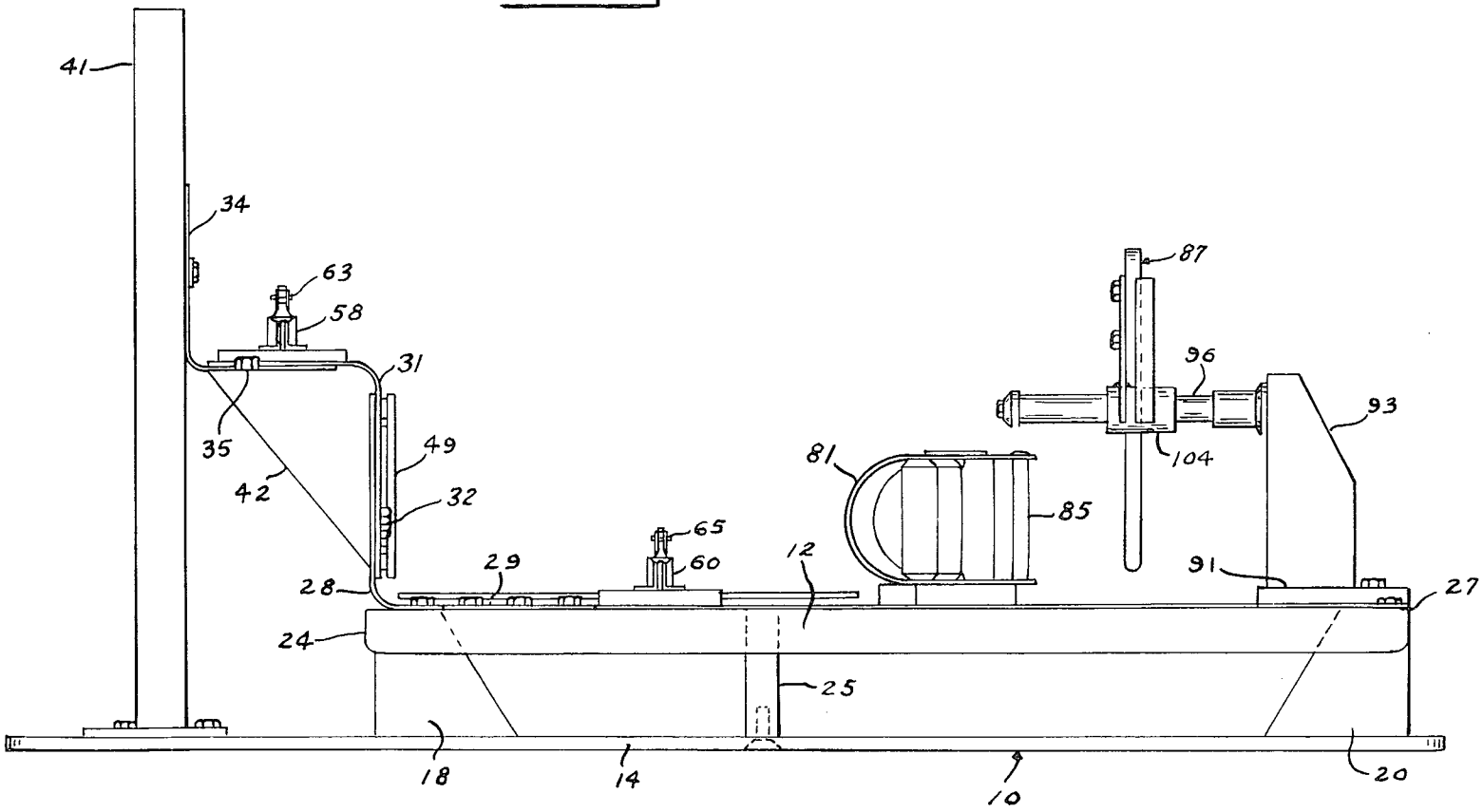
FIG. 1 is a side elevational view of a restraint system according to the invention.

Reference is now made to FIG. 1 of the drawing which shows a subhuman primate restraint system 10 having an animal support frame 12 supported upon attachment plate members 14 and 16 by means of support riser brackets 18 at one end and support riser brackets 20 at the other end. The plate members 14 and 16 are adapted to be attached to a platform member which may be secured to a centrifuge. The brackets 18 and 20 may be bolted or welded to attachment members 14 and 16 and also to angle aluminum frame support members 22 and 24. A lateral support riser member 25 extends between plate members 14 and 16 and is bolted or welded to members 14, 16, 22 and 24. A body support plate 27 is bolted to frame members 22 and 24. A seat plate member 28 is secured to frame members 22 and 24. The members 22 and 24 include a plurality of threaded holes to permit the seat plate member 28 to be secured at various positions on members 22 and 24. Various width spacer plate members, such as shown at 29, are inserted in any space left between plate members 27 and 28.

A second seat plate member 31 is secured to plate member 28 by bolts 32. Slots 33 permit movement of member 31 with respect to member 28 to permit adjustment of the size of the seat.

A foot support plate member 34 is adjustably secured to plate member 31 by means of bolts 35 and slots 36. The foot plate support member may be secured at various positions on foot plate support struts 40 and 41. The struts 40 and 41 may be secured at various positions on attachment plate members 14 and 16. Seat support members 42, one of which is shown, have threaded holes to receive bolts 32 and 35 and provide support for members 28, 31 and 34.

Figure 2:
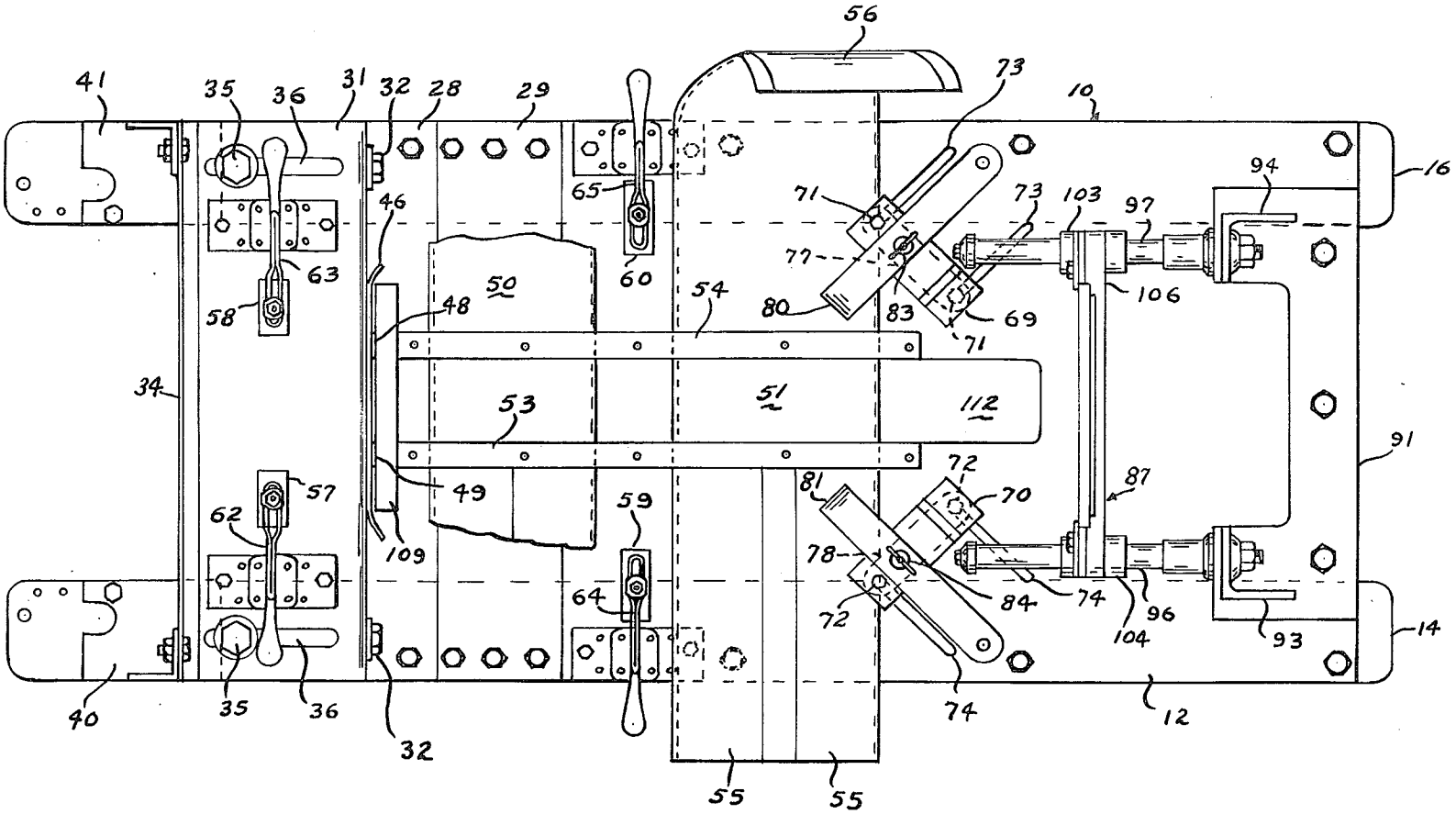
FIG. 2 is a top view of the device of FIG. 1.
Figure 3:
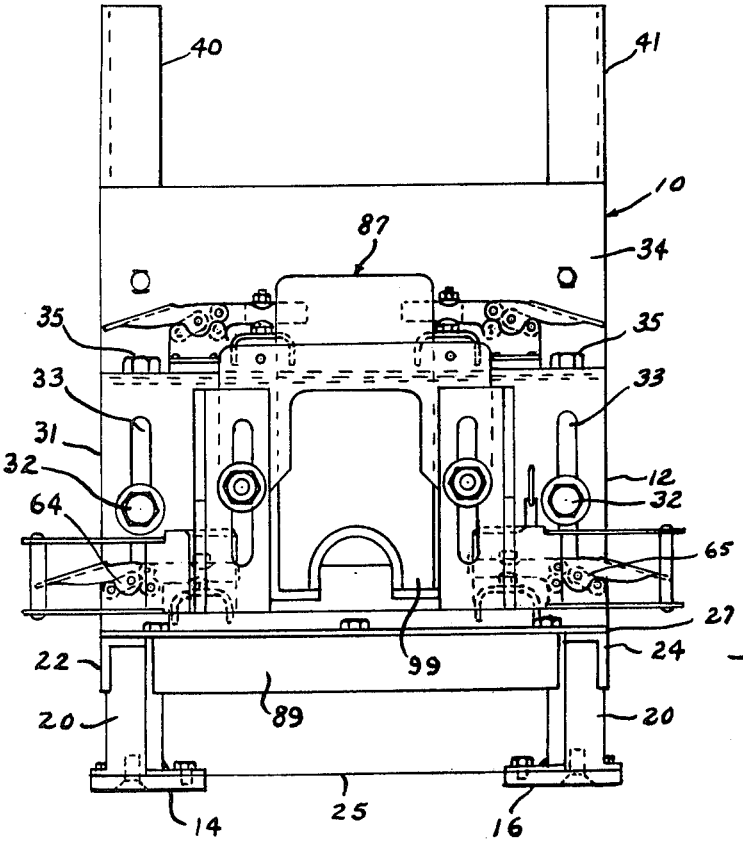
FIG. 3 is a right end view of the device of FIGS. 1 and 2.

The lap restraint strap 46 is secured to seat plate member 28 by means of strap retainers 48 and 49. A pair of body restraint straps 50 and 51 are secured to support members 26, 28 and 29 by means of strap retainers 53 and 54. By providing two body restraint straps to hold the upper and lower portions of the animal torso, the body of the test animal is more available for test equipment. The restraint straps 46, 50 and 51 are secured by Velcro hook material 55 and pile fastener material 56, as indicated on strap 51 in FIG. 2.

The legs and arms of the animal are held by U-shaped restraint members 57, 58, 59 and 60. The U-shaped restraint members are secured to standard over center toggle clamps 62, 63, 64 and 65. The clamps used were toggle clamps #215 U made by Destaco.

Figure 4:
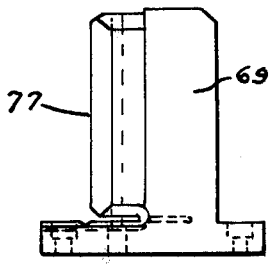
FIG. 4 is an enlarged side view of the upper arm restraint for the device of FIGS. 1–3.
Figure 5:
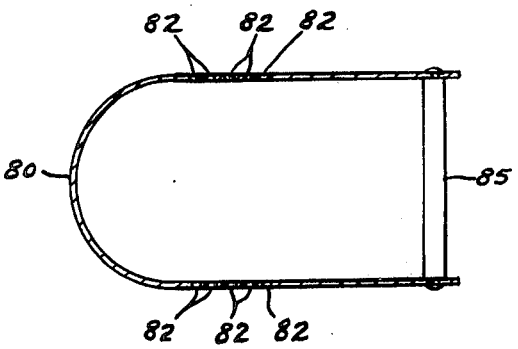
FIG. 5 is an enlarged side view of the upper arm strap clamp for the device of FIGS. 1–3.
Figure 6:
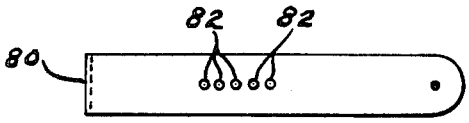
FIG. 6 is a top view of the device of FIG. 5.
Figure 7:
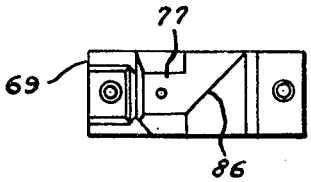
FIG. 7 is a top view of the device of FIG. 4.

With animals such as baboons and monkeys, it is difficult to provide arm and leg restraints due to their ability to pull their hands and feet through very small restraints. By providing the lap strap 46 in the manner shown in FIG. 10 the animal is unable to lift its legs to draw his feet through leg restraints 57 and 58. A similar provision is made for preventing removal of the hands from restraints 59 and 60. Movable shoulder blocks 69 and 70 have bolts 71 and 72 movable in slots 73 and 74. The upper arm blocks are placed in position for any animal and then secured in that position by bolts 71 and 72 and nuts, not shown. The shoulder clamps include projections 77 and 78, shown in greater detail in FIGS. 4 and 7, for receiving U-shaped arm strap clamps 80 and 81. The clamps 80 and 81 are secured to the shoulder clamps by means of removable pins 83 and 84. The strap clamps 80 and 81 have several holes 82, shown in FIGS. 5 and 6, to permit the accommodation of various animals. The clamps 80 and 81 are pivotable on pins 83 and 84 to permit some movement of the animals. Cut away portions 86 on blocks 69 and 70 permit rotational movement of clamps 80 and 81. Spacers 85 are provided at the open ends of clamps 80 and 81. Restraint members 57, 58, 59 and 60 and U-shaped clamps 80 and 81 are coated with a latex layer, not shown, to prevent damage to the animal by the edges of the clamps and restraint members.

Figure 8:
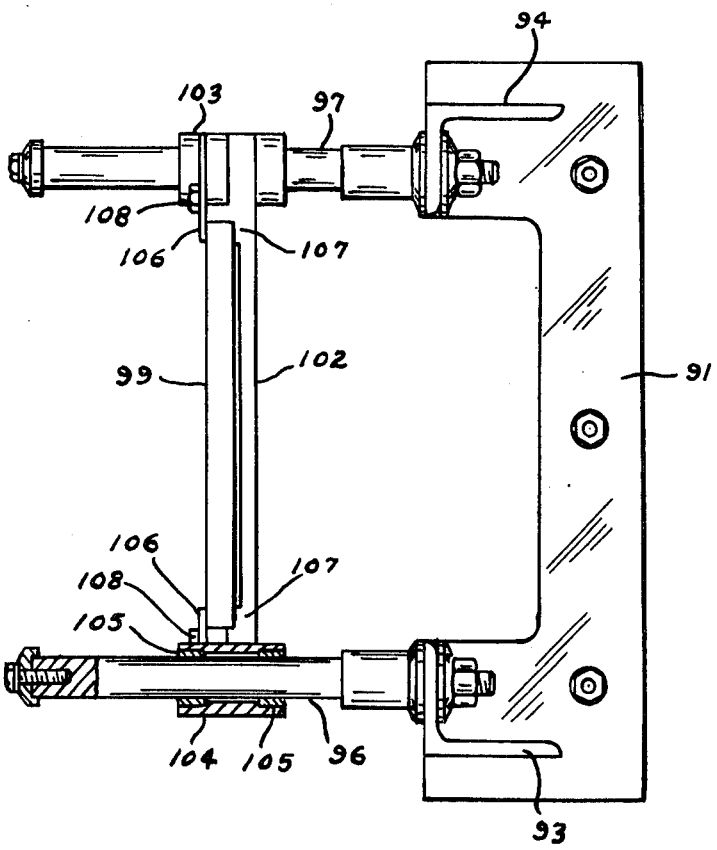
FIG. 8 is an enlarged partially cut away top view of the neck restraint apparatus for the device of FIGS. 1–3.
Figure 9:
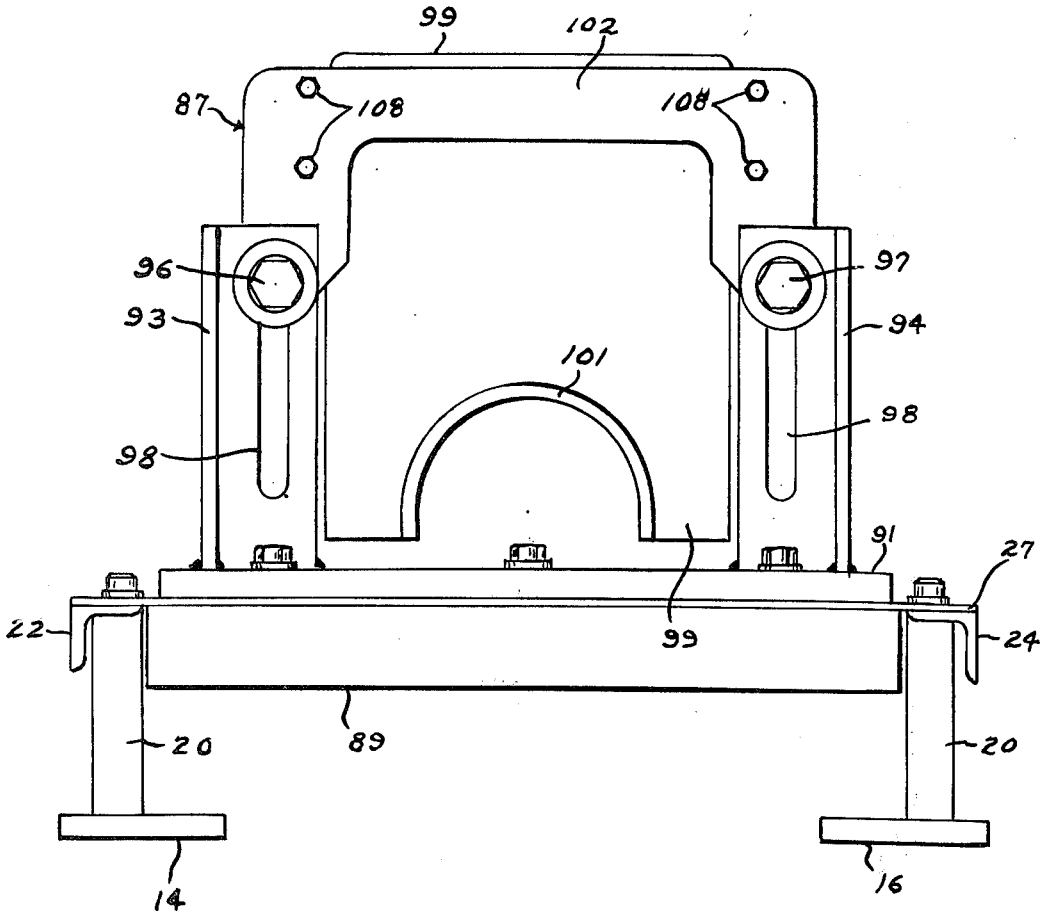
FIG. 9 is an enlarged end view corresponding to FIG. 3 of the neck restraint apparatus for the device of FIGS. 1–3.

A cross beam 89 is positioned below plate member 27. A neck restraint assembly 87, shown in greater detail in FIGS. 8 and 9, includes a plate member 91 which is bolted through plate member 26 to cross beam 89. A pair of angle aluminum support members 93 and 94 are welded to the plate member 91. A pair of guide rods 96 and 97, made of a material such as iron or steel, are secured to the support members 93 and 94. The rods 96 and 97 are secured in slots 98 to permit adjustment.

Neck restraint members 99 with a U-shaped notch 101 is supported on a restraint support member 102. Member 99 was made of a transparent plastic material. Member 102 is adapted to hold various size restraint members with neck restraint slots of different sizes to fit different animals. The support member 102 is welded to two slider members 103 and 104 which slide on guide rods 96 and 97 with tight fitting Teflon bushings 105. The restraint member 99 is clamped between members 106 and 107 by tightening bolts 108. Movement of the slider members 103 and 104 on guide rods 96 and 97 permits some movement of the head and upper portion of the animal's body but prevents excessive flection of the head. To reduce weight the parts of the support frame, unless otherwise indicated, were made of aluminum.

Figure 10:
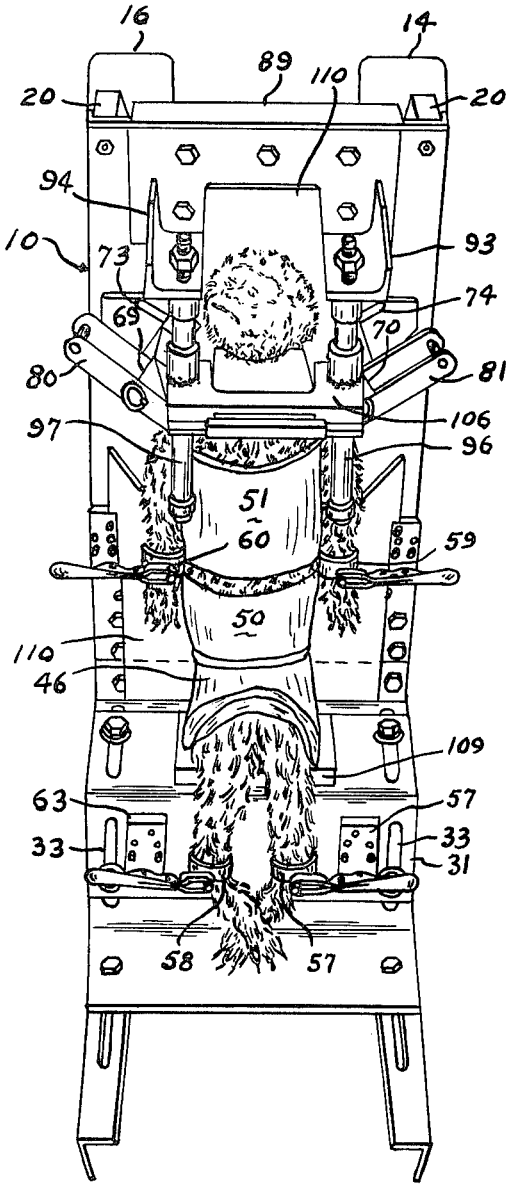
FIG. 10 shows the restraint device of FIGS. 1–3 with an animal in place.

Energy absorbing pads 109 and 110, shown in FIG. 10, of a material such as insulite made by Uniroyal Rubber Co. are provided over the seat and body support plate. Other energy absorbing pad material could be used.

In the operation of the device, the animal is anesthetized and placed on the restraint apparatus 10 with its back on pad 110. The particular procedure used in securing the animal to the restraint apparatus is determined by the particular test to be made. After the animal is anesthetized and the desired test apparatus is applied to the animal, the animal is placed with its back on the restraint apparatus and the test leads are passed through opening 112. In most cases, the neck restraint would be applied first to keep the animal from biting the test personnel if the animal should awaken while being secured to the restraint apparatus. The arms and legs are then secured by clamps 57, 58, 59 and 60. Lap restraint strap 46 is then secured by engaging the hook and pile fasteners. Movable blocks 69 and 70 are then positioned adjacent the upper arms of the animal and secured in position. The U-shaped arm straps 80 and 81 are then passed around the arm of the animal and pins 83 and 84 are inserted in the appropriate holes 82. The test leads passing through opening 112 would again be checked and body straps 50 and 51 then secured by engaging the hook and pile fasteners. The animal, after awakening, is then ready for tests.

There is thus provided a restraint apparatus for large subhuman primates which prevents escape of the animal during tests and which does not severely limit the test that can be made on the animal.

We claim:

1. A restraint assembly for subhuman primate, comprising: a rigid frame member; said frame member including a pair of plate members attachable to a platform which may be secured to a centrifuge; said frame member including a body support plate member and an adjustable seat and leg support member; means for securing the body of a subhuman primate to the body support plate; lower arm restraint means for securing the arms of said subhuman primate to the body support plate member; lower leg restraint means for securing the legs of said subhuman primate to said seat and leg support member; upper leg restraint means secured to said seat and leg support member for preventing removal of the legs of the subhuman primate from said lower leg restraint means; upper arm restraint means secured to said body support member for preventing removal of the arms of the subhuman primate from the lower arm restraint means; means attached to said frame member for holding the head and neck of the subhuman primate against the body support member; said head and neck holding means including slidable means for permitting movement of the head and neck of the subhuman primate.

2. The device as recited in claim 1 wherein said means for holding the head and neck of the subhuman primate against the body support includes a frame member secured to the body support frame; a pair of rods adjustably secured to said frame member; a neck restraint plate member including a cut out portion adapted to fit around the neck of the subhuman primate; means for securing said neck restraint plate member to said pair of rods; said means for securing the plate member to the pair of rods including the slidable means for permitting movement of the head and neck of the subhuman primate; said means for securing the plate member to the pair of rods also including means for clamping the neck restraint plate member in place around the neck of the subhuman primate.

3. The device as recited in claim 2 wherein said means for preventing removal of the arms of the subhuman primate from the arm restraint means includes a pair of adjustable upper arm blocks adapted to be secured adjacent the upper arms of the subhuman primate; a U-shaped clamp member, adapted to be positioned around each of the arms of the subhuman primate, pivotably secured to each of said upper arm blocks.

4. The device as recited in claim 3 wherein said means for securing the arms of the subhuman primate to the body support plate includes a first pair of over center toggle clamps; a U-shaped restraint member, adapted to fit over the arms of the subhuman primate, secured to each of said over center toggle clamps; said means for securing the legs of the subhuman primate to the seat and leg support member includes a second pair of over center toggle clamps; a U-shaped restraint member; adapted to fit over the legs of the subhuman primate, secured to the second pair of over center toggle clamps.

5. The device as recited in claim 4 wherein the means for preventing removal of the subhuman primate from the leg restraints includes a first wide strap secured to said seat and leg support member; said strap including means for securing the first strap around the upper portion of the legs of the subhuman primate.

6. The device as recited in claim 5 wherein said means for securing the body of the subhuman primate to the body support plate includes a second wide strap member adapted to be positioned adjacent the lower portion of the torso of the subhuman primate and a third wide strap member adapted to be positioned adjacent the upper portion of the torso of the subhuman primate, secured to said body support plate; said second strap member including means for securing the second strap around the lower portion of the torso of the subhuman primate; said third strap member including means for securing the third strap around the upper portion of the torso of the subhuman primate.

* * * * *